United States Patent [19]

Chung et al.

[11] Patent Number: 4,746,097

[45] Date of Patent: May 24, 1988

[54] HIGH EFFICIENCY HYDRAULIC JACK/AIR PUMP

[76] Inventors: Yo C. Chung, No. 20-100, Tsu Shi Village, Shui Shang Hsiang, Chia I. Hsien; Richard Lee, No. 419, Sec. 4, An Ho Rd., Tainan City, both of Taiwan

[21] Appl. No.: 24,027

[22] Filed: Mar. 10, 1987

[51] Int. Cl.[4] ..... B66F 3/24

[52] U.S. Cl. ..... 254/93 H; 254/1

[58] Field of Search ..... 337/22, 27, 89; 310/68 C; 60/539, 581; 417/521; 254/93 H, 93 R, 1

[56] References Cited

U.S. PATENT DOCUMENTS

| | | | |
|---|---|---|---|
| 1,983,444 | 12/1934 | Dry | 254/1 |
| 2,034,605 | 3/1936 | Carman | 254/93 H |
| 2,313,744 | 3/1943 | Hays | 337/22 |
| 2,420,910 | 5/1947 | Richards | 254/93 H |
| 4,052,687 | 10/1977 | Kimball et al. | 337/27 |
| 4,219,747 | 8/1980 | Hornvng et al. | 310/68 C |
| 4,512,151 | 4/1985 | Yamatani | 60/581 |
| 4,517,541 | 5/1985 | Ubukata et al. | 337/89 |
| 4,598,898 | 7/1986 | Hsu et al. | 254/93 H |
| 4,923,743 | 6/1985 | Wang | 254/93 H |

*Primary Examiner*—Robert C. Watson

*Attorney, Agent, or Firm*—Poms, Smith, Lande & Rose

[57] ABSTRACT

An overload protected motor which drives a motor assembly to urge a connector rod up and down. The connector rod has two piston heads connected in line with each other, a large pneumatic piston head to pump air and a smaller hydraulic piston head to pump hydraulic fluid. The pneumatic head reciprocates in an air cylinder which has an air inlet and an air outlet. Both the inlet and the outlet have spring-loaded air stops which allow for one-way passage of air into and out of the air cylinder, respectively.

1 Claim, 4 Drawing Sheets

HIGH EFFICIENCY HYDRAULIC JACK/AIR PUMP

BACKGROUND OF THE INVENTION

This invention relates to hydraulic jacks in combination with air pumps, especially those which are used for automobile repair. In the past, these two devices were separate, thereby requiring the use of two motors, or if they were one device they were inefficient since the motor pumped air and urged the hudraulic jack up and down at the same time, and could not be used separately. If it was only desired to use the air pump, then energy was wasted in moving the cylinder up and down. It is the purpose of this present invention, therefore, to mitigate and/or obviate the above-mentioned drawbacks in the manner set forth in the detailed description of the preferred embodiment.

SUMMARY OF THE INVENTION

A primary objective of this invention is to provide a device which can be used either to charge up a cylinder or can be used as a hydraulic jack.

Another objective of this invention is to provide such a device which is more efficient than the prior art.

Further objective and advantages of the present invention will become apparent as the following description proceeds, and the features of novelty which characterize the invention are pointed out with particularity in the claims annexed to and forming a part of this invention.

BRIEF DESCRIPTION OF THE DRAWINGS

FIG. 3-B is a view of section 3—3 in FIG. 3-A; and

DETAILED DESCRIPTION OF THE PREFERRED EMBODIMENT

Figure 1:
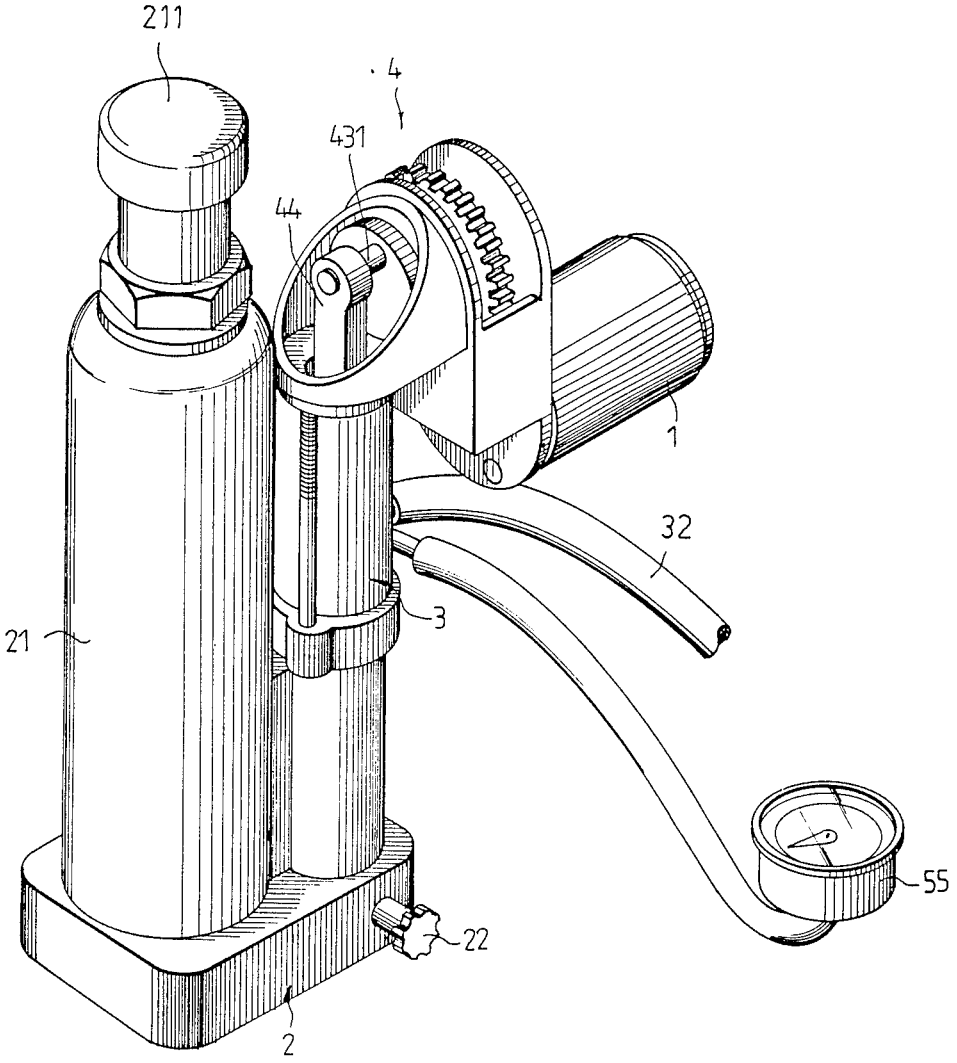
FIG. 1 is a perspective view of the preferred embodiment of the present invention.

Referring to FIG. 1, it can be seen that the present invention comprises a motor 1, a motor assembly 4, a base 2, and a lift structure 21. An air pressure gage 55 and an air hose 32 are also included in the present invention.

Figure 2:
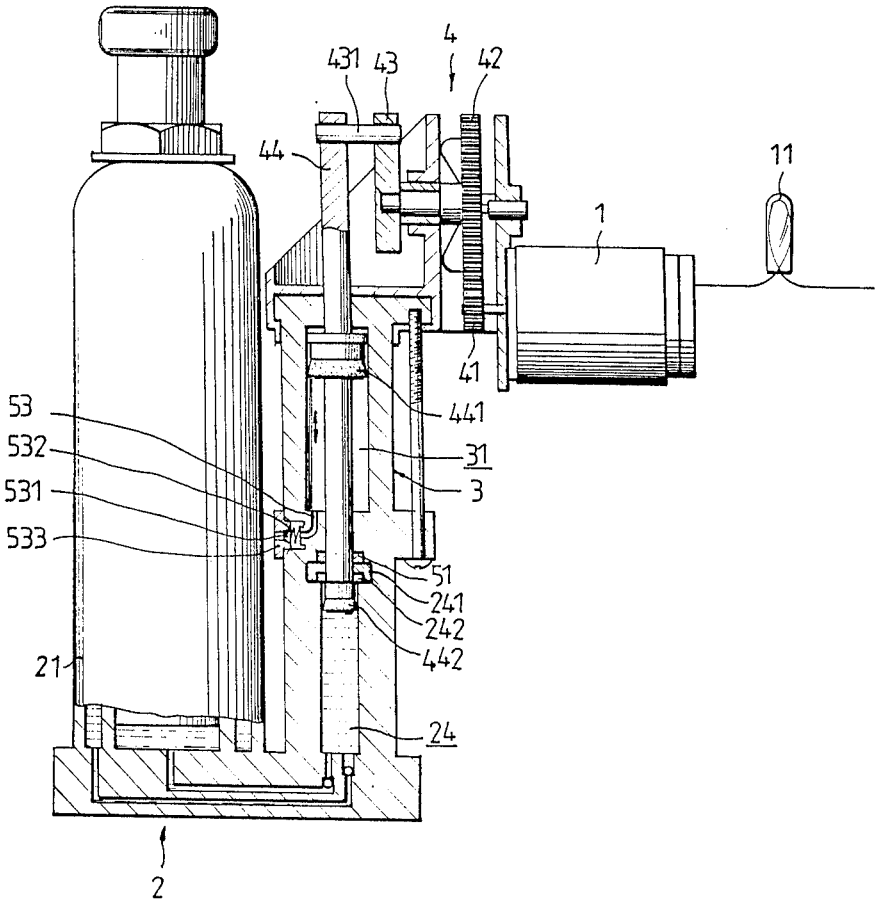
FIG. 2 is a partially cut away elevational view of the preferred embodiment of the present invention.

Referring further to FIG. 2, the basic structure of the present invention can be seen. The motor 1 drives a motor assembly 4 which comprises a motor gear 41, a reduction gear 42, a cam 43, a camshaft 431, and a connector rod 44. More detailedly, the motor assembly 4 has a motor gear 41 on the end of its shaft which drives a reduction gear 42 which in turn drives a cam 43. The cam 43 eccentrically retains a camshaft 431 thereon. The circular motion of the pin 431 is translated into vertical motion of the pneumatic head 441 through camshaft 431 and connector rod and crankshaft 431. More importantly, the connector rod 44 drives both a pneumatic head 441 and a hydraulic head 242 which are in line with each other on extension rod 45, at the lower end of which the pneumatic head is fixed. These two heads 441 and 442 correspond to the pneumatic system and the hydraulic system of the present invention, and each has its own cylinder to reciprocate in respectively. Since the volume of air which is to be pumped into a car tire is substantial, and since air is compressible, the pneumatic head and its cylinder are of course much larger than the hydraulic head 442 so as to provide for quicker pumping of the air.

In actual operation, when the motor 1 is activated, and is driven by the camshaft 431 and the connector rod 44 urges the pneumatic head 441, and hence the extension rod 45 and pneumatic head 442, to reciprocate. As the pneumatic head 441 (and the hydraulic head 442) is urged downwards, the air in the air cylinder 31 is pumped out to a car tire or some other inflatable article. As the connector rod 44 reverses its direction and is pulled upwards, the pneumatic head 441 also goes upwards. Because the air cylinder 31 is air tight, the pneumatic head 441 creates a vacuum as it returns upwards. This vacuum, or lower relative pressure with respect to the outside atmospheric air pressure, allows air to enter the air cylinder 31 through the air inlet 53. The operation of the hydraulic system, including the lift structure 21 and the hydraulic cylinder 24 etc. is not novel per se and as such will not be described in detail herein.

Figure 3A:
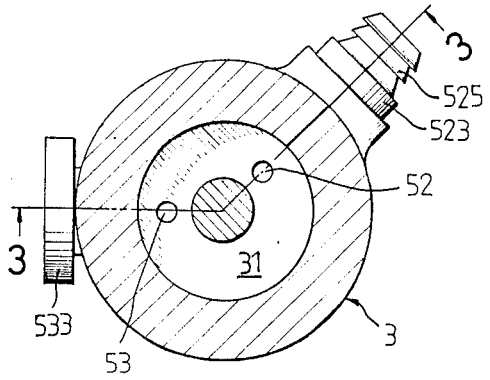
FIG. 3-A is a cross-sectional view showing the air inlet and outlet portion of the preferred embodiment of the present invention.
Figure 3B:
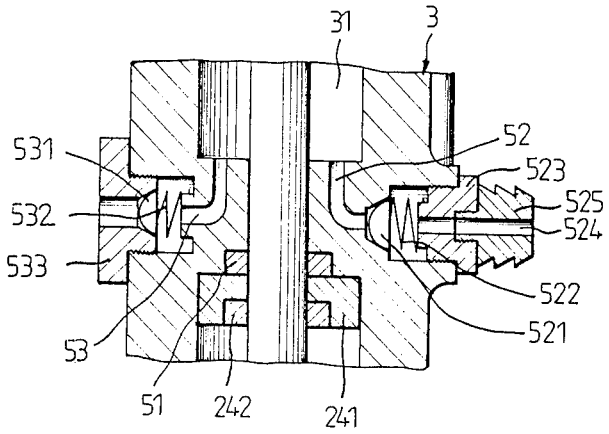

Further referring to FIG. 3-B, a closer view of the air inlet 53 section and nozzle 525 sections can be seen. A spring 532 is set at protrudes from the end of the air inlet 53. On the other end of the spring 532 is a semi-circular inlet stop 531 which is urged by the spring 532 into a countersink on the inside face of the inlet plug 533. The inlet plug 533 is threadably secured in the cylinder block structure 3. When the pneumatic head 441 (shown in FIG. 1) is urged upwards and a vacuum is created on the inside of the air cylinder 31, the greater outside atmospheric pressure counteracts and overcomes the restoring force of the spring 532 and pushes the inlet stop 531 inwards so as to allow air to enter the air cylinder 31. After air enters the air cylinder 31, the inside pressure becomes approximately equal to the atmospheric pressure and the restoring force of the spring once again closes off the air inlet 53. Next, the pneumatic head moves back in a downward direction. This action, in turn, increases the pressure inside the air cylinder 31 so as to force open the exit stop 521, which is loaded by spring 522, and pump air (presumably) to a car tire. After the pneumatic head reaches its lowest point, it will be urged upwards again by the piston rod 44 (see FIG. 1). The pressure inside the air cylinder 31 will therefore decrease and the restoring force of spring 522 will close the discharge passage 52 once again (i.e. the discharge passage 52 is normally closed by the spring-loaded exit stop 521). FIG. 3-A further clarifies the situation by showing the major air entry and exit points. First, air enters through the inlet plug 533 and then goes through the air inlet 53 until it exits into the air cylinder 31. Next the air exits from the air cylinder 31 into the discharge passage 52 and finally out through the nozzle 525, which is screwed into the discharge plug 523, which is in turn screwed into the cylinder block 3.

Figure 4:
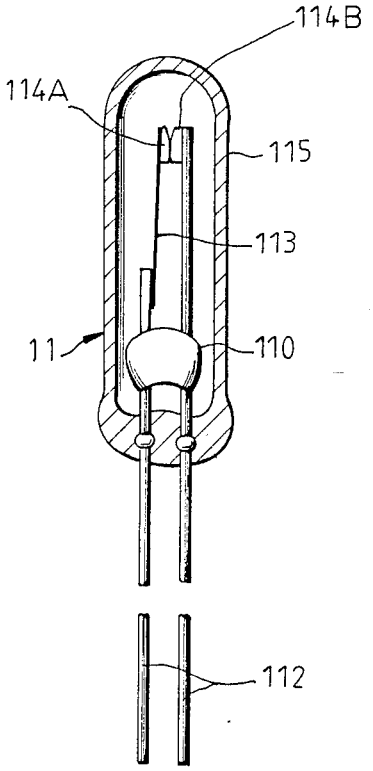
FIG. 4 is a cross-sectional view of the overload control switch of the preferred embodiment of the present invention.

One important point concerning this invention is that the motor 1 has a built-in bimetallic control device 11 which is electrically in series with the motor 1 and which prevents the motor from overloading. This device 11 can be seen in FIG. 2 in relation to the motor 1. From FIG. 4, the operation of the control device 11 can be more readily understood. As the load increases, the amount of current running to the motor correspondingly increases. For example, if the user forgets to turn off the motor even after the air in the car tire has reached much too high a pressure, say 60 psi, then the motor must work much harder to make pump air than when the air pressure was 30 psi. Accordingly, more current runs through the bimetallic control device 11 and the temperature increases therein. This increase in temperature causes the bimetallic snap blade 113, which has a silver contact 114A on the end thereof, to bend away from the other silver contact 114B of the other copper lead 112. This, in turn, stops the flow of current to the motor and the motor stops running, thereby preventing the tire from rupturing.

When it is desired to use only the pneumatic portion of the present invention, the hydraulic fluid release valve 22 (see FIG. 1) may be turned so as to allow the hydraulic fluid to be diverted from the lift 211 itself and thereby not waste energy raising and lowering said lift structure 211.

As various possible embodiments might be made of the above invention without departing from the scope of the invention, it is to be understood that all matter herein described or shown in the accompanying drawings is to be interpreted as illustrative and not in a limiting sense. Thus it will be appreciated that the drawings are exemplary of a preferred embodiment of the invention.

We claim:

1. A hydraulic jack / air pump comprising:

(A) a base comprising a lift structure, a cylinder block structure and a motor assembly, said motor assembly comprising a motor gear which drives a reduction gear which drives a cam which drives a camshaft;

(B) a motor having a bimetallic overload switch electrically in series with an electric motor;

(C) a connector rod driving a pneumatic head; said pneumatic head urging an extension rod to reciprocate; said extension rod having a hydraulic head fixed on a lower end thereof; said connector rod being driven by said camshaft;

(D) an air inlet with a spring-loaded inlet stop protruding therefrom, said inlet stop being retained by a countersink which is on the inside face of an inlet plug, said inlet plug being threadably secured in said cylinder block structure; and (E) a discharge passage, said discharge passage being normally closed by an exit stop, said exit stop being spring-loaded against a discharge plug, said discharge plug having a nozzle threadably secured therein, and said discharge plug being threadably secured in said cylinder block structure.

* * * * *